United States Patent [19]

Anwer et al.

[11] 4,017,272

[45] Apr. 12, 1977

[54] PROCESS FOR GASIFYING SOLID CARBONACEOUS FUEL

[75] Inventors: Jamil Anwer, Cologne, Germany; Ira Norman Banchik, Lakeland, Fla.; Gerhard Wilhelm Bode, Lechenich, Germany; Werner Lemberg, Cologne-Weidenpesch, Germany; Kuldip Kumar Sud, Cologne, Germany

[73] Assignee: Bamag Verfahrenstechnik GmbH, Germany

[22] Filed: May 27, 1976

[21] Appl. No.: 690,549

Related U.S. Application Data

[63] Continuation-in-part of Ser. No. 584,130, June 5, 1975, abandoned.

[52] U.S. Cl. ..... 48/197 R; 48/202; 48/206; 48/210; 48/DIG. 4; 201/31; 252/373

[51] Int. Cl.[2] ..... C10J 3/16; C10K 1/20

[58] Field of Search ..... 48/202, 206, 210, 197 R, 48/DIG. 4; 252/373; 201/31; 423/244

[56] References Cited

UNITED STATES PATENTS

| | | | |
|---|---|---|---|
| 3,579,302 | 5/1971 | Sefton | 423/244 |
| 3,607,157 | 9/1971 | Schlinger et al. | 252/373 |
| 3,840,353 | 10/1974 | Squires | 48/206 |
| 3,872,025 | 3/1975 | Singleton | 252/373 |

*Primary Examiner*—Robert L. Lindsay, Jr.
*Assistant Examiner*—George C. Yeung
*Attorney, Agent, or Firm*—Morton, Bernard, Brown, Roberts & Sutherland

[57] ABSTRACT

A process for continuously gasifying carbonaceous material using fluidizing medium and oxygen-containing gas, under controlled feed rates and certain delivery conditions, and under selective processing conditions to produce a product rich in carbon monoxide and hydrogen is provided. If desired, the product can be produced with increased amounts of methane. Gasification is conducted under pressure in a fluidized bed to produce a gaseous reaction product, and char solids are coproduced. Additional increments of oxygen-containing gas with steam is selectively introduced. The product is passed through a dilute-phase, maintained at certain temperatures, at a certain superficial velocity, and for a certain residence time. The presence of undesirable heavy hydrocarbon by-products is precluded. Char, in removal from the bottom of the bed, is contacted with steam or inert gas to recover sensible heat. Cooled product gas is provided having less than about 4 grains of solid per scf at certain conditions. Partially spent char is removed from the product for discharge or certain purposes. The product is cooled and is conducted in a heat recovery zone to recover heat values at least a part of which are used to produce steam, a portion of which is utilized in the process. The cooled product gas is conducted through a high efficiency, high pressure-drop type, a scrubber to remove fine partially spent char particles and provide a gas product containing minimal amounts of solids, a carbon monoxide content of at least about 10 percent (vol.), hydrogen, and a desired BTU content. The pressure in the gasifier is maintained by means of back-pressure control applied to the gas system at a point downstream of the gasifier.

28 Claims, 4 Drawing Figures

PROCESS FOR GASIFYING SOLID CARBONACEOUS FUEL

This application is a continuation-in-part of application Ser. No. 584,130, filed June 5, 1975, now abandoned, herein incorporated by reference.

This invention relates to a process for continuously gasifying solid carbonaceous fuel under selective conditions to provide a gas rich in carbon monoxide and hydrogen, and, if desired, with enriched amounts of methane, and to methods employing this process to produce low and medium BTU fuel gases, powergas (i.e., gas for driving turbines), reducing gas, methanol and ammonia.

Coal was displaced in the residential and commercial markets by oil and gas because it is more difficult to handle than other fuels, leaves a residue that must be disposed of, and creates dust and dirt during its use. Indigenous oil and gas resources can no longer satisfy the burgeoning demand for fuel in the non-Arabian countries. The abrupt end of an era of abundant energy, based upon petroleum and natural gas as dominant forces in the economy, has reintroduced coal as a potentially significant energy source. Fortunately, there are large reserves of coal. Coal mined in the U.S. alone could provide over 100 times as much energy as the U.S. consumed in 1973. However, the capacity to utilize these coal reserves is dependent upon the provision of advanced technology to translate them efficiently and economically into more useful forms of energy, and this technology, to be useful on a practical scale, should be capable of use in commercial plants to provide substantial production (e.g. in commercial amounts) of, for instance, gasified products produced from the coal. In addition, in view of present-day environmental standards, the translation or conversion of coal must be conducted in an environmentally-acceptable manner.

An object of the present invention is the provision of an efficient process for continuously gasifying solid carbonaceous material under selective conditions, which process can economically convert substantial amounts of this material into synthesis gas, i.e., a gas rich in carbon monoxide and hydrogen, in an environmentally-acceptable manner. Another object is to provide a process which can gasify a wide size range of solid carbonaceous material from lignite through coal and coke, caking and non-caking coals, and coals having a high ash content. Another object is to provide a process which is not unduly sensitive to variations in coal properties, i.e. ash content, moisture content, etc., during operation. Another object is to provide a process which uses a fluidized bed in a state of agitation to intimately mix the fuel particles so as to promote a uniform temperature between the solids and gases and permit the gasification conditions to approach equilibrium in a short period of time. Another object is to provide a process which employs fluidizing and gasifying media wherein very little operational or maintenance effort is required and very high on-stream factors can be achieved. Another object is to provide a process which can utilize air and/or oxygen as the gasifying medium.

Another object of this invention is the provision of a process which enables an increase in production of effluent gas per unit cross-section of reactor and a reduction in the overall gasification plant compression requirement. Another object is to provide a process which is not complex and hence, is trouble-free in operation, and which can tolerate variances in operating conditions within a given range without major equipment adaptations.

Another object of the present invention is the provision of such a process wherein incoming coal is devolatized and the volatile off-gases need not be separated and collected but instead, are utilized in the process to avoid an environmental problem. Another object is to provide a process which can be conducted in a single stage operation employing a fluidized bed of carbonaceous material wherein high production of product gas per unit cross-section of reactor (e.g., depending on operating pressure, 32,000 or more Scf/hr.-sq. ft.) can be achieved to minimize the size of the equipment required to handle a given volume of gas. Another object is to provide a process wherein a reduction in the overall gasification plant compression requirements can be achieved to minimize capital costs attributable to product compression station(s) and to minimize the daily operating cost of power for product gas compression. Another object is to provide a process which can use high efficiency equipment for removing particulate material from the product gas to provide a satisfactory product while still maintaining a product gas having sufficient pressure to be handled with little, and usually no, additional compression.

Another object is the provision of such a process which can be utilized in multiple coacting stages (trains) to provide, at acceptable economics, the massive capacity required in present-day commercial operations. Another object is to provide a process which can be efficiently intergrated, in a coacting relationship, into methods for the production, particularly commercial production, of low/medium BTU fuel gas, powergas, reducing gas, methanol or ammonia to produce such products at an economically attractive cost. Another object is to provide a method for producing fuel gas wherein a high conversion of fuel values (e.g. 85 to 90 percent) can be achieved to provide a fuel gas containing high heating values.

Frequently, carbonaceous material, such as coal, contains sulfur, which sulfur may be provided as gaseous materials such as carbonyl sulfide, and hydrogen sulfide, and the like, through action of the gasification process. These sulfur-containing components may be disadvantageous in both fuel gas and synthesis applications of the product gas. For instance, the burning of fuel gas containing sulfur compounds leads to the production of sulfur dioxide, an undesirable environmental pollutant. In synthesis applications, the sulfur may adversely affect catalysts employed, i.e., may be a catalyst poison, and may also provide undesirable side products in the synthesis product. It is therefore desirable to reduce the sulfur-content of the product gases at least to an environmentally-acceptable level or a synthesis-acceptable level.

Another object is the provision of a gas stream at an elevated pressure such that desulfurization of the gas stream may require a reduced level of compression, if any, to achieve desulfurization pressures.

In accordance with the process of the present invention for continuously gasifying solid, particulate carbonaceous material under selective conditions to produce a gaseous product rich in carbon monoxide and hydrogen, and, if desired, methane, the material, basic fluidizing medium and oxygen-containing gas (the basic gasifying medium), at controlled feed rates and under certain delivery conditions, are introduced into an enclosed gasifier. The gasifier has a finite fluidized bed of material as a lower dense-phase having an upper phase boundary and a lower phase boundary. Gases which the evolve out of the fluidized bed and contain entrained particles essentially from therein an upper dilute-phase, particulate-entrained, gas zone contiguous to the upper phase boundary of the bed.

The carbonaceous material, under fluidization, is devolatized, carbonized, oxidized, hydrogenated and gasified (hereafter collectively referred to as "gasified"), with selective amounts of fluidizing medium and oxygen-containing gas under selective gasification conditions, in the bed. The raw product gas is produced under selective conditions to minimize or preclude the presence of undesirable heavy hydrocarbon by-products.

The gaseous, raw reaction product is passed through the dilute-phase gas zone to produce, as overhead, a gaseous product rich in carbon monoxide and hydrogen and, if desired, methane, which product, as a rule, contains undesirable particulate material (e.g., partially spent char) and, as bottoms, an ash product (e.g., partially spent char) composed of particles larger than those in the fluidized bed. The ash product moves downwardly through the bed and is discharged from the bottom of the gasifier. The overhead product gas leaves the gasifier under operating pressure and at high temperatures (e.g., about 1500° F. to 2200° F.), and a cooled product gas is provided (e.g., at temperatures from about 200° F. to 500° F.) wherein heat values are recovered from it while the gas is cooled and wherein substantial amounts of partially spent char solids are removed. The recovered heat values, or a portion thereof, are advantageously employed to produce steam, a portion of which is utilized in the process. The cooled product gas, cooled in a heat recovery zone, at the heat recovery zone pressures, which are less than the pressures in the gasifier, is advantageously conducted through a high efficiency, high pressure-drop type, scrubber to remove fine partially spent char particles and provide a gas product containing less than about 0.1 (e.g. less than about 0.01) grains of solids per standard cubic foot of gas, a carbon monoxide content of at least about 10 percent (vol.), a hydrogen content of at least about 10 percent (vol.), and a BTU content of at least about 90 BTU per standard cubic foot. The pressure in the gasifier is advantageously maintained by means of back-pressure control applied to the gas system at a point downstream of the gasifier.

The carbonaceous material may be coke or coal or other substantially carbon-containing solid materials. The coal may be caking as well as moderately caking and non-caking; however, when caking coal is employed, care should be taken in its introduction into the gasifier such that feed material being subjected to increased temperatures as it passes into the gasifier does not result in deleterious agglomeration. Typical coals include lignite, subbituminous, bituminous, and the like. Generally, the more reactive the coal, the lower the gasification reaction temperature which may be required. The carbonaceous material may have an ash content since this process provides for the removal of ash from the gasifier, although a loss in sensible heat with the ash will also occur. The carbonaceous material which is fed to the gasifier may be of varying quality and the process may readily switch from one grade of coal to another without physical modification. For the sake of ease of understanding, the carbonaceous material will hereafter be exemplified with coal.

The fluidized bed employed in this process is capable of handling a wide range of particle sizes of coal and, fines and large particles may simultaneously be employed. The coal fed to the gasifier is generally in the size range of up to ⅜ inch in diameter. Frequently, the median particle size is about 4 to 8 mesh (U.S. Sieve Series). The coal may be dry, e.g., at a moisture content less than 10 percent (wt.), although it need not always be subjected to a drying operation, prior to being fed to the gasifier. The coal feedstock may frequently contain up to 20 percent (wt.) or more of water.

The fluidizing medium is basically steam which also serves as a reactant. It can also be air, carbon dioxide or recycle gas, each with or without steam. For the sake of ease of understanding, the fluidizing medium will hereafter be exemplified with steam. Steam is particularly attractive as a fluidizing medium, and may also be used as a diluent gas for the gasifying medium, in that it can be condensed and easily separated from the product gas, leaving a higher heat value product gas. Furthermore, steam is readily available at the pressures employed and can advantageously be generated from the waste heat produced by the overall exothermic nature of the process.

The gasifying medium is basically the oxygen-containing gas and it also aids in the enhancement of the fluidization of the bed. It contains free or combined oxygen which is available for reaction with carbon. It may be oxygen or can be oxygen with diluents, for instance, air or air enriched with oxygen. It also is preferably introduced into or within the bed at several, spatially-separate points. Diluents for the gasifying medium can be employed, and they may be employed in amounts above that amount required in the gasification reactions; carbon dioxide, recycled product gas, nitrogen and the like can be used, but steam is preferred. Non-reactive diluents, such as nitrogen, reduce the temperature in the gasifier and reduce the heating volume of the product gas per unit volume of gas. A diluent such as carbon dioxide by enter into the reaction to provide carbon monoxide, and such a reaction is endothermic. If the product gas is to be of pipeline quality, e.g., a medium BTU fuel gas (about 280 Btu/scf), an oxygen-containing gas containing as much nitrogen as air may not be acceptable. On the other hand, if the product gas is to be employed in synthesizing, for instance, ammonia, air or oxygen-enriched air, may be a suitable oxygen-containing gas, but oxygen is preferable. Oxygen alone is preferably employed when methanol is the desired product. Air is suitable for the production of low BTU fuel gas or powergas (about 125 Btu/scf). Also, when the oxygen-containing gas contains diluents, a greater volume of gas must be compressed to obtain the desired pressure in the gasifier. Moreover, when air is used as the oxygen-containing gas, air is also advantageously used with steam as the fluidizing medium and, when oxygen is used as the oxygen-containing gas, steam alone is advantageously used as the fluidizing medium.

The fluidized bed displays a distinct upper phase boundary, or surface which appears much as would the surface of a vigorously boiling liquid. Generally, the height of the fluidized bed will be about 1.3 or 1.5 to 3 times the height of the bed in compact form. The bed will suffer losses by not only solid material being converted to product gas, but also through the removal of ash particles (if ash is contained in the coal) from the lower portion of the bed and the removal of smaller particles which may become entrained in the gases flowing upwardly in the gasifier. It is therefore desirable to replenish the bed with additional coal to maintain production of product gas. Advantageously, the coal is introduced, in the gasifier, directly into, and above or below the upper phase boundary of, the fluidized bed at a pressure slightly in excess of the pressure in the gasifier, at a temperature from about ambient to 400° F or 600° F. or 1000° F., at a essentially continuous rate to maintain steady state-operation in the gasifier, and in amounts at a rate sufficient to maintain the upper phase boundary at a given level of about 4 to 20 feet above the lower phase boundary of the fluidized bed wherein the ratio of the height of the dilute-phase, gas zone to the height of the fluidized bed is from about 3:1 to 10:1.

The primary gasification (e.g., oxidation or reaction) of the coal occurs in the fluidized bed. The coal particulates being gasified in the bed have an average residence time therein generally of about 30 to 100 minutes which is substantially greater than the residence time of the gaseous product (about 3 to 50 seconds). The residence time of given particulates in the bed will be sufficient to oxidize substantial amounts of available carbon to carbon monoxide. The bed is under strong agitation, provided primarily by the fluidizing medium and aided by the gasifying medium, which, as noted above, may be described as a boiling motion.

The oxygen-containing gas, advantageously with from up to about 50, e.g., about 0.1 to 50, percent (vol.) of steam, and generally at average bulk temperatures up to about 1000° F., e.g, of about 100° to 1000° F., and at a pressure slightly in excess of that in the gasifier, is advantageously introduced at spatially-separate points, substantially uniformly distributed circumferentially, at different levels in the gasifier and in amounts sufficient to substantially uniformly contact and gasify the constituents of the fluidized bed under controlled selective reaction conditions. The temperature of the oxygen-containing gas should be as high as possible within the range to maximize overall efficiency. Advantageously, at least about 50 percent (wt.) of the steam being introduced into the fluidized bed, is introduced at the lower phase boundary of the fluidized bed, at spatially-separate points, substantially uniformly distributed circumferentially, generally at a temperature up to about 1200° F., a pressure slightly in excess of that in the gasifier, and at a rate sufficient to fluidize the lower portion of the bed.

Each point in the bed tends to have the same temperature with respect to time, due to the agitation provided by a fluidized bed. However, the composition of, and distribution points for introduction into the bed of, the fluidizing medium may be used to obtain temperature profile variations in the bed which may result in different quality product gases. For example, the coal particulates in the lower portion of the bed may come in contact with steam. Steam is preferably injected into the lower level of the bed to fluidize the particulates and, advantageously, to recover heat values from, and to cool, the ash (e.g., partially spent char) particles discharging from the bottom of the bed, and thus the steam is preheated. Similarly, increments of oxygen-containing gas may be supplied to the upper portion of the bed to subject remaining carbon values to oxidative reaction again. Additional increments of oxygen-containing gas, advantageously with up to about 10, e.g., from about 0.1 to 10, percent (vol.) of steam, can be advantageously introduced at or just above the phase boundary between the fluidized bed and dilute phase at spatially-separate points, substantially uniformly distributed circumferentially, in amounts sufficient to react with carbon values leaving the fluidized bed, thus increasing the temperature in the dilute-phase, and to enhance the carbon-conversion efficiency of the process to provide a raw product gas containing at least about 50 percent of the oxidized carbon in the form of carbon monoxide.

The area of the bed proximate to the phase interface, i.e., the interface between the bed and the dilute-phase, gas zone, may experience generally higher temperatures since the primary oxidative reactions occur there and this area is in contact with hot reaction gases from the lower portions of the bed.

the gasification reactions which occur in this process involve the oxidation of carbon as well as the reduction of carbon dioxide to provide a product gas, which essentially contains carbon monoxide and hydrogen. The primary reactants are the coal and oxygen supplied by an oxygen-containing gas and steam. The basic gasification reactions can be depicted as follows:

$$C + O_2 = CO_2 \text{ (exothermic)}$$

$$C + 0.5\ O_2 = CO \text{ (exothermic)}$$

$$C + CO_2 = 2CO \text{ (endothermic)}$$

$$C + H_2O = CO + H_2 \text{ (endothermic)}$$

$$C + 2H_2O = CO_2 + 2H_2 \text{ (endothermic)}$$

$$C + 2H_2 = CH_4 \text{ (exothermic).}$$

The rates of these reactions are favored by elevated temperatures. The coal in the fluidized bed is advantageously gasified to provide a maximum temperature in the gasifier in the range of about 1500° to 2400° F. and advantageously, the bulk temperature in the dense phase is below the softening temperature of any ash contained in the material to produce a gaseous reaction product including or containing carbon monoxide, hydrogen, carbon dioxide, methane and diluents, which product evolves into the dilute phase, and, in connection with the gasification, partially spent char solids are coproduced. However, the temperature in the gasifier dense phase is preferably maintained about 50° F. below the softening temperature of ash. The temperature employed may depend on the amount of diluent gas in the fluidizing and gasifying media, the nature of the coal, the softening temperature of the ash, the heat tolerance of the gasifier, and the like. Generally, the temperature is at least about 1500° F. and up to about 2400° F. or more, and, for good thermal efficiency, preferably about 1700° to 2000° or 2200° F. The dilute-phase is advantageously maintained at the maximum temperature possible commensurate with the properties of any contained ash.

The reaction in the gasifier are advantageously conducted under the superatmospheric pressures, generally above 1.5, for instance from about 1.5 to 20, advantageously from about 2 or 2.5 to 15, and preferably from about 6 to 14, atmospheres absolute. The selection of the superatmospheric pressure which may be employed in a given plant will depend on the design and pressure tolerance of the processing equipment, the pressure drop provided by the equipment downstream of the gasifier, the particular use desired for the product gas, whether multiple gasifiers are used in trains, and the like. The use of the higher reaction pressures in this invention may also enhance the degree of utilization of the coal to provide product gas and increase the throughput of the gasifier.

Selective amounts of coal, oxygen-containing gas and steam are used in this process, depending on several vaiables, to maintain operating conditions (e.g., temperatures), product gas heating values, and product rate. The overall amount of steam employed should be sufficient to maintain the bed in the desired fluidized state and also at the desired temperature. A particular advantage of the present process is that the steam desired for fluidization and gasification can be provided by the recovery of heat values from the process to produce steam. In this aspect, a cooled product gas, advantageously having less than about 4 grains of solid per standard cubic foot of gas, can be provided at approximate gasifier pressures and at temperatures better suited for further processing, wherein substantial amounts of partially spent char are removed from the raw product gas for discharge from the process or for recycle or for processing under different conditions, and wherein the cooling of product gas to temperatures of about 200° F. to 500° F. is conducted in a heat recovery zone to recover heat values. High pressure steam in excess of that required by the process can be generated and is therefore available for product gas compression turbine drives and air compressor drives when air is used. In another advantageous aspect of the present process, generally up to about 60 percent (wt.) of partially spend char is removed from the bottom of the bed and is advantageously contacted with steam being introduced into the bed at the lower phase boundary to recover sensible heat from the char and preheat the steam.

The ratio between the coal and oxygen-containing gas should enable sufficient heat to be generated by oxidation reactions to sustain the gasification reactions, but less than that amount which would lead to the excess production of carbon dioxide (e.g., less than about 15 to 20 percent, vol.). Advantageously, at a constant coal feed rate, the ratio of oxygen-containing gas and steam to coal is selectively controlled to maintain the desired temperature in the bed. When air is used as the gasifying medium, steam turbine-driven compressors can be used with advantage to provide the air desired for the gasification of coal. As noted previously, additional increments of steam or oxygen-containing gas can also be selectively injected at or near the upper level of the bed to further gasify carbon particles entrained in the dilute-phase, which is provided at a height sufficient to permit further gasification of entrained carbon particles and to allow a separation of a portion of the entrained solid material.

The gas and entrained particles which evolve out of the fluidized bed, form the dilute-phase, particulate-entrained, gas zone immediately above the bed. Unlike the bed, the dilute-phase does not form an upper phase boundary, or surface; rather, it expands into the available volume provided by the enclosed gas generator, and thus, its dimensions are governed by the dimensions of the surrounding gasifier. Entrained particles will usually be withdrawn from the dilute-phase along with the product gas.

The height of the dilute-phase containing entrained particles is sufficient to provide additional time for the particles to remain under the gasification conditions to undergo further gasification and to enable some of this solid material in the dilute-phase to return to the bed, prior to the exit of the product gas from the gasifier. The height of the dilute phase as compared to the bed may be varied. For instance, it may be shortened to increase the amount of the particulate material being carried out. However, if the height of the dilute phase is insufficient, excessive carbon values may be lost from the gas generator. The upper portion of the gas generator may be constructed to have a greater diameter than the lower portion to reduce the superficial gas velocity and thus increase the residence time of particles in the dilute phase and enhance the return of entrained particles to the fluidized bed. With conventional feed particle size distribution, between about 40 and 70 percent of the solid material leaving the gasifier will generally exit in the product removed from the dilute-phase. Generally, the height of the dilute-phase will range from about 3:1 to 10:1, preferably from about 4:1 to 8:1, times the height of the fluidized bed. Another way to extend the time for which the fine char particles are subjected to gasification conditions is to recycle a part of the char recovered in a high temperature cyclone.

The raw, gaseous reaction product gas resulting from the reaction of carbon, steam and oxygen-containing gas generally has a residence time in the upper dilute-phase in the gasifier of about 2 to 50, preferably about 5 to 30, seconds. The superficial velocity of the raw product gas, through the gasifier, is well above the point of incipient fluidization and it will generally range up to about 20 feet per second, as a function of operating pressure.

The product gas is advantageously rich in carbon monoxide and hydrogen, for instance, generally containing about 50 to 90 percent, preferably about 55 to 85 percent, of carbon monoxide on a total oxidized carbon basis. Carbon dioxide will essentially comprise the remainder of oxidized carbon. Minor amounts of methane may also be present, and generally less than about 10 percent or even 6 percent of the carbon in the product gas is methane. Greater amounts (e.g., greater than about 10 percent and up to about 35 percent) of methane can be produced by employing methane-enhancing conditions in the gasifier. The presence of methane is advantageous when the product gas is to be employed as a fuel gas or powergas. The amount of methane produced may be influenced by the operating conditions employed for gasification. The methane-enhancing conditions advantageously include the use of reduced amounts of steam, when employed, the amount of the steam that is reduced is replaced, in whole or in part, by recycle gas; temperatures ranging from about 1500° F. to 1700° F.; and pressures in the gasifier of at least about 10 atmospheres absolute. In addition, the coal is advantageously introduced above the upper phase boundary of the fluidized bed.

In a method for producing fuel gas in accordance with the process of this invention, the cooled product gas is desirably desulfurized. Advantageously, a two-step process for desulfurization is employed with the first step providing the sulfur components in an acid gas form, i.e., as hydrogen sulfide, which can then be selectively absorbed from the gas. Hydrolysis may be employed to convert, for instance, carbonyl sulfide, to hydrogen sulfide. Hydrolysis may be preferably conducted in the presence of a carbonyl sulfide-hydrolyzing catalyst under pressures in excess of about 60 psia at hydrolysis temperatures, for instance about 200° to 400° F. Sufficient water for the hydrolysis is often contained in the cooled product gas. The reaction is of an exothermic nature.

The effluent is generally cooled to temperatures required for absorption, i.e., temperatures at which equilibrium is favorable for absorption of hydrogen sulfide. The gases may often be cooled to a temperature of about 70° to 100° F. prior to entering the absorption unit. Absorption may be conducted with a conventional, selective hydrogen sulfide absorbent. Typical absorption systems include, but are not necessarily limited to the Alkazid and Stetford processes. The absorption is often conducted at a temperature of about 70° to 100° F., and preferably under a pressure in excess of about 60 psia. The spent absorption solution may be regenerated to provide a rich, hydrogen sulfide-containing gas. Elemental sulfur values may be recovered from the hydrogen sulfide-containing gas by conventional means, for instance, by the Claus process, which may be supplemented with a sulfur dioxide absorption unit to provide an environmentally-acceptable tail gas.

The gas from the gasification process may also be employed in methods of synthesizing chemicals, for instance, ammonia and methanol. In this case, the coal is advantageously introduced into the gasifier at or below the upper phase boundary of the fluidized bed. The general reactions for the production of methanol and ammonia are $$CO + 2H_2 \rightarrow CH_3OH$$

$$CO_2 + 3H_2 \rightarrow CH_3OH + H_2O \text{ and}$$

$$3H_2 + N_2 \rightarrow 2NH_3$$

The cooled product gas is rich in carbon monoxide and hydrogen. Since, in each of these synthesis methods, significant amounts of hydrogen reactants are required, the yield of product may be enhanced by subjecting the gases to a shift reaction under shift reaction conditions and over a suitable sulfur-resistance catalyst. In the shift process, carbon monoxide and water vapor react in a one to one mole ratio to provide hydrogen and carbon dioxide. For the synthesis of methanol, a gas containing about 2 to 2.5 moles of hydrogen per mole of carbon monoxide plus carbon dioxide is frequently employed. Often, the shift reaction may be relatively efficient and a stream of product gas may be bypassed around the shift reactor and combined with the effluent from the shift reactor to provide a gas containing the desired proportions of hydrogen and carbon oxides. In the production of ammonia, carbon monoxide is not required; therefore, the shift reactor may provide an effluent containing less than about 3, preferably less than about 2, volume percent of carbon monoxide. The shift reaction is generally conducted at a temperature of about 500° to 900° F. under a pressure in excess of 200 psia. It is seen that the increased production of carbon monoxide and hydrogen provided in accordance with the process of this invention may advantageously increase the yield of the synthesis product.

Advantageously, the effluent from the shift reactor is desulfurized. At the same time, excess carbon dioxide may be removed. Typically, the sulfur components, usually present as hydrogen sulfide and carbonyl sulfide, are removed by absorption concurrently with the excess carbon dioxide. For this purpose, useful physical absorbents appear to offer the greatest potential. The absorption is preferably conducted at pressures in excess of 600 psia. The absorbent may be regenerated by heating and depressuring, and the liberated hydrogen sulfur-rich gas may be treated to obtain elemental sulfur values.

Carbon oxides and hydrogen gas are reacted to produce methanol in accordance with known technology, for example the ICI process, which often employs pressures of approximately 1500 psia and pressures as low as 750 psia may also be employed with similar catalysts for producing methanol. With the increased pressure provided by the invention, the increased throughput will permit a reduction in size of equipment and decreases compression requirements of the synthesis gas.

When ammonia is the desired product, the gases produced in accordance with this invention are also subjected to the shift conversion and acid gas removal processes described above. Following this, final purification and adjustment to stoichiometric ratios is achieved by washing the gas with liquid nitrogen. Final synthesis of ammonia is achieved by any one of a number of conventional processes, such as the ICI process, which often uses pressures in excess of about 2000 psia and temperatures ranging from about 600° to 1000° F. With the increased pressure provided by the invention, the increased throughput will permit a reduction of size of equipment and decrease compression requirements of the synthesis gas.

The invention may be further understood and exemplified with reference to the drawings in which.

Figure 1:
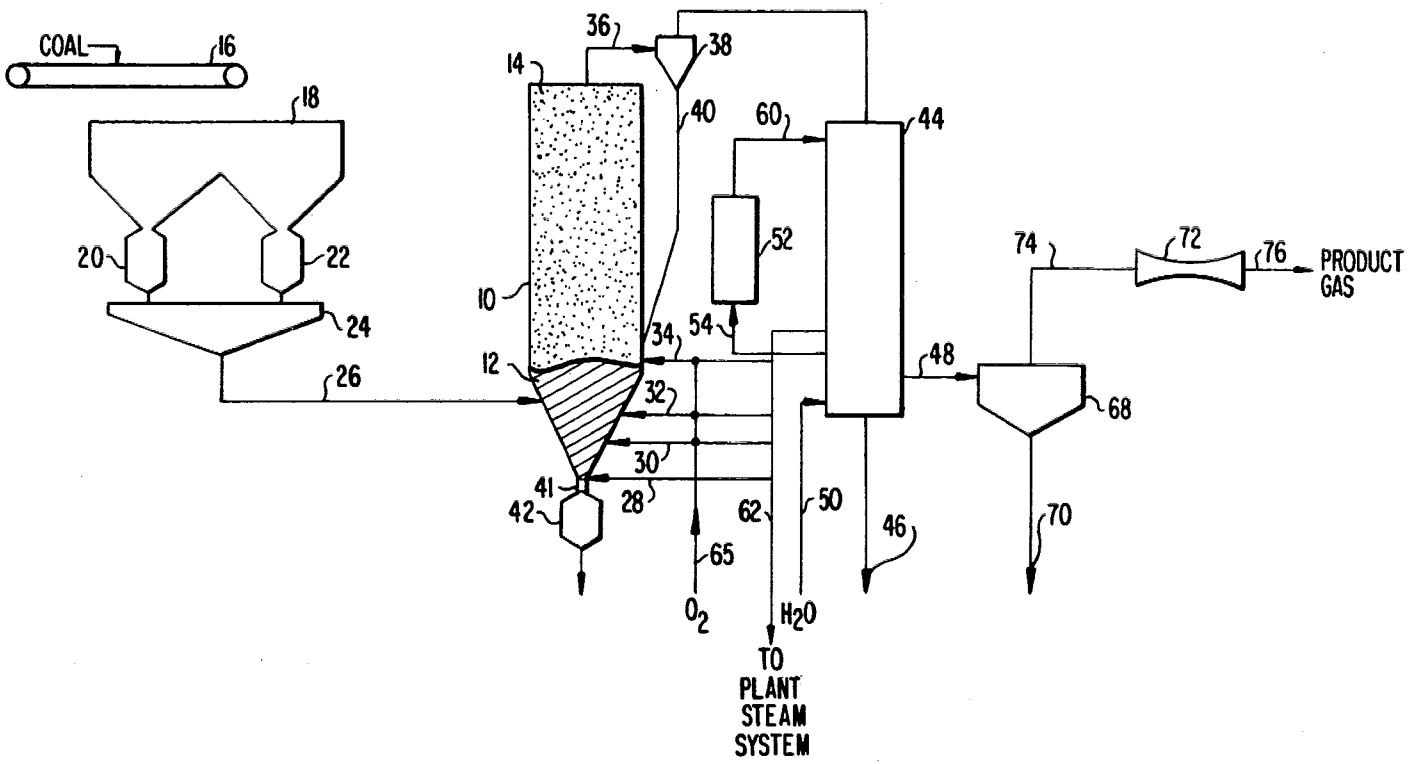
FIG. 1 is a schematic diagram of an embodiment of the process of this invention for gasifying coal under selective conditions to provide a product gas which is rich in carbon monoxide and hydrogen.

In FIG. 1, gasifier 10 is depicted with fluidized bed 12 and dilute phase 14. It is usually designed such that the lower portion is a frustoconical segment, and the base of the bed resides therein. The reactants are combined in the bed.

The solid material feed to gasifier 10 may be effected in the following manner. Crushed coal is delivered to conveyor 16 and is transported to hopper 18. Conveyor 16 may be a belt conveyor, bucket conveyor, or the like. Conveniently, a chain conveyor may be employed since typically a chain conveyor does not jam nor does it stall when the receptacle is full.

Hopper 18 is shown as delivering crushed coal to two lock hoppers 20 and 22. In actual practice, particularly in operations operating at pressures greater than, say, 2.5 atmospheres absolute, it may be desirable to provide additional lock hoppers, for insuring a continuous feed of coal to the gasifier. The lock hoppers operate to increase the pressure around the coal to a level suitable for introduction into the gas generator. Generally, the coal charge is at a pressure in excess of that in the gasifier to avoid a backflow of gases. Other means may be employed for bringing coal at ambient pressure to elevated pressure.

The lock hoppers operate on a cycle. In the first stage of the cycle, a lower valve in the hopper is closed and the upper valve is opened to permit a charge of coal to enter the lock hopper. When the lock hopper is charged, an upper valve is closed and a gas is introduced into it to provide an increased pressure. In the final stage, the charge at the increased pressure is released through the bottom of the hopper. The charge drops into holding hopper 24, as depicted. The introduction of pressurizing gas, e.g., an inert gas such as nitrogen or carbon dioxide, to the lock hopper may be continued during discharge to hasten delivery of the charge.

The coal is shown as being transported from holding hopper 24 to gasifier 10 through a screw conveyor which is schematically represented as line 26. The introduction of the coal may be at several points to promote better distribution, and, for a given product, enhance the operating characteristics of the process. Transport means may also be advantageously employed, and include rotary star feeders, and the like.

Often, the fluidizing gases are injected into the gasifier at a plurality of points. In this manner, the reaction in the dense phase bed may be controlled to increase utilization of the coal and provide a high quality product gas. As is illustrated, a stream containing essentially all (100 percent) steam is introduced through line 28 at the lower phase boundary of the fluidized bed. The steam not only serves as a primary fluidizing gas, but also, it cools ash (e.g., partially spent char) particles for discharge from the lower portion of the gas generator. Oxygen-containing gas which may also contain steam as diluent is introduced through lines 30, 32 and 34. The oxygen and steam-diluent support the gasification reactions and assist along with any other diluents in the oxygen-containing gas in fluidizing the bed and controlling the temperature. Line 34 preferably injects the oxygen-containing gas at or just above the phase boundary between the bed 12 and the dilute phase 14. The gas inlets are frequently semi-tangential nozzles. Generally, to insure good agitation, the fluidized bed may have a height to maximum diameter ratio of about 1:2 to 5:1. The dilute-phase, gas zone comprises entrained particles from the bed.

The raw product gas is shown as being treated in cyclone 38 after exiting gasifier 10 via line 36. The inclusion of cyclone 38 depends upon the particular feedstock used, particularly its size. Line 40 is illustrated as returning the recovered particulate material to the bed as the material may contain recoverable carbon values. If the recovered particulate material is to be returned to the gasifier, it is generally beneficial to maintain the reaction temperature to avoid undue heat loss and avoid expending carbon values. The particular material separated by a cyclone may be utilized differently, for instance, as a fuel, or as a feed, when using multiple stages, to another gasifier. The carbon values which are unreacted in the product leaving the gasifier exhibit lower gasification reactivity under the gasification conditions in the gasifier, and it may be beneficial to employ such materials in a gasifier operating under more severe conditions.

In FIG. 1, the bottom of gasifier 10 is also provided with a means for removing ash. The larger and heavier ash particles are unstable and fall from the fluidized bed. These particles are collected and transported by water-cooled screw conveyor 41 to discharge lock hopper 42 for removal from the system. A crusher may be provided to reduce the particle size of the ash to a size which may be easily transported.

The raw product gas from gasifier 10 is cooled by indirect heat exchange in heat exchanger 44 where heat is recovered from it. Particulate material which is settled out of the gases during cooling may be removed from heat exchanger 44 via line 46. The particulate material may be disposed of in a manner like that for disposing of the ash from the bottom of the gas generator. The cooled gases exit heat exchanger 44 from line 48.

The heat exchange medium for heat exchanger 44 is shown as steam. Boiler feed water enters heat exchanger 44 via line 50 and, after being preheated, passes to steam drug 52 via line 54. Steam drum 52 may be in communication with a radiant boiler (not shown) in the upper portion of gasifier 10. The heat from the radiant boiler may be employed for indirect heat exchange to the steam in steam drum 52. Saturated steam, which was generated in heat exchanger 44, leaving steam drum 52 via line 60 returns to boiler 44 where it is super-heated prior to its delivery to the plant steam system via line 62. A portion of the steam from line 62 is combined with oxygen-containing gas provided by line 65 for introduction into the gasifier as diluent for the gas via lines 30, 32 and 34. Another portion of the steam passes through line 28 to the gasifier. The process may be operated under such conditions that sufficient steam is generated for its export from the gasification plant. Under certain conditions, there will be sufficient sensible heat available which heat may be advantageously applied to the preheating of the oxygen-containing gas in the waste heat recovery train or, when desired, applied also to satellite process(es).

The cooled gases exiting heat exchanger 44 are shown as passing, by line 48, through cyclone 68, which is provided with line 70 for removal of the separated particulate materials (i.e., partially-spent char), and to scrubber 72 by line 74. The bulk of the partially-spent char in the product gas is removed in the heat recovery unit and cyclone can be passed to a char hopper (not shown) by means of a transfer screw conveyor. In combination, the heat recovery unit and cyclone can remove at least about 50, and more than 75, percent (wt.) of the entrained solids in the product gas. From the char hopper, the char is conveyed to the battery limits in the case of fuel gas plants or to the coal fired boiler char feed bin in ammonia or methanol plants. A water scrubber is provided to scrub the conveying nitrogen before venting.

Scrubber 72 removes particulate material and condenses steam from the gas. The gas from the cyclone flows through the venturi scrubber 72 where the remaining char is removed to a level of less than 1 grain/1000 SCF. To minimize water requirements, the venturi water is cooled and recirculated after removing the ash in a settler. Make-up water may be required for the ash settler. The char, in the form of a wet sludge, is removed from the settler and pumped to the battery limits.

This invention permits the use of high efficiency scrubbers. Suitable scrubbers include spray towers, cyclonic spray towers, venturi scrubbers (e.g., high efficiency, high pressure-drop type), and the like. The venturi or venturi-type scrubbers are particularly advantageous in that further downstream processing of the gases for particulate removal may not be required. Electrostatic precipitators have been employed downstream of the scrubber to remove entrained particles when required. The gases exit the scrubber via line 76.

EXAMPLE I

By way of example, the system depicted in FIG. 1 is employed to gasify a subbituminous coal having about 50% carbon, 20% ash, 15% water, and 10% oxygen and a higher heating value dry of 10,300 Btu/lb. The ash has a softening point of 2300° F., melting point of 2600° F., and a flow point of 2700° F. The coal is crushed to a particle size range of 0 to ⅜ inch.

The gasifier is about twenty meters in height and has an inside diameter of about 5 meters and is conically tapered at the bottom. The top of the fluidized bed is at a height of about 4 meters from the bottom of the gasifier.

About 1600 tons of coal are passed to the gasifier per day, which is operating at a pressure of about nine atmospheres absolute. About 13,000 pounds per hour of steam are delivered to the gasifier, with about 11,000 pounds per hour of steam being supplied below the fluidized bed. About 870,000 standard cubic feet per hour of a mixture of about 5% (vol.) steam and 95% (vol.) air is fed through line 34 to the gasifier; 1,850,000 standard cubic feet of a mixture of 2% (vol.) steam and 98% (vol.) air through line 32; and 1,480,000 standard cubic feet of a mixture of 3% (vol.) steam and 97% (vol.) air through line 30. The residence time of the gases in the gasifier is about 20 seconds and the superficial velocity is 3.7 feet per second. Essentially all of the reaction with the coal and coal particles evolving out of the bed is conducted in the gasifier within 14 meters from the bottom.

The reaction is conducted at 1900° to 2100° F. and the gases exiting the gasifier at a pressure of about 9 atmospheres have 19% (vol.) CO, 7% (vol.) $CO_2$, 12% (vol.) $H_2$, 1.4% (vol.) methane (5 percent of the carbon in the product gas), 50.3% (vol.) $N_2$, and 10.3% (vol.) steam, and are at a temperature of about 1800° F. The waste ash comprises 78 percent ash and 22 percent carbon. The gas passes through heat exchanger 44 and cyclone 68 where heat is recovered from it and further particulate removal is effected and, in leaving exchanger 44, is at a temperature of about 300° F., and in leaving cyclone 68 contains about 4 grains of dust per standard cubic foot of gas. It is then passed through venturi scrubber 72, upon leaving, the gases are at a temperature of about 100° F., a pressure of about eight atmospheres, and contains less than 0.001 grains of dust per standard cubic foot of gas. The high heating value of the gas is about 127 Btu per standard cubic foot. The carbon efficiency is about 90 percent based on the carbon content of the gas divided by the carbon content of the coal. The gasification efficiency is about 65 percent based on the ratio of higher heating values of the gas to coal. The overall product gas compression requirement is 33,000 horsepower for delivery at 15 atmospheres absolute per $71 \times 10^9$ Btu per day.

EXAMPLES II and III

Example I is essentially repeated, except employing absolute pressure of three and six atmospheres, with the following results presented in tabular form. Example I is also repeated using atmospheric pressure for purposes of comparison.

| Pressure, atmospheres absolute | 1 | 3 | 6 |
|---|---|---|---|
| Product Gas Compound, vol.% (dry) | | | |
| $CO_2$ | | 7.1 | 7.4 |
| CO | | 22.0 | 21.7 |
| $H_2$ | | 14.0 | 13.5 |
| $CH_4$ | | 0.8 | 1.2 |
| $N_2$ | | 56.1 | 56.2 |
| Higher heating value, Btu/SCF | | 124 | 125 |
| Composition of By-Product Char, % | | | |
| Ash | | 78 | 78 |
| Carbon | | 22 | 22 |
| Carbon efficiency, % | 89 | 89 | 89 |
| Gasification efficiency | 65 | 65 | 65 |
| Overall Plant Compression Requirement, horsepower (thousands) for delivery at 15 atmospheres absolute per $71 \times 10^9$ Btu/day | 123 | 89 | 47 |

The above comparisons show the advantageous overall plant compression requirements provided by the process of the present invention, while, at the same time, maintaining carbon and gas efficiencies.

EXAMPLE IV

The process in Example I is essentially followed except that the gasification is conducted at a temperature of 1600° F., a pressure of 14 atmospheres absolute, and 50 volume percent of the steam being introduced below the fluidized bed is replaced with recycle gas to produce a gaseous product, exiting the gasifier, having a methane content of 7% (vol.) methane (25 percent of the carbon in the product gas). In this particular example it is not necessary to replace the steam by recycle gas to a significant extent since a low amount of steam was employed in Example I.

Figure 2:
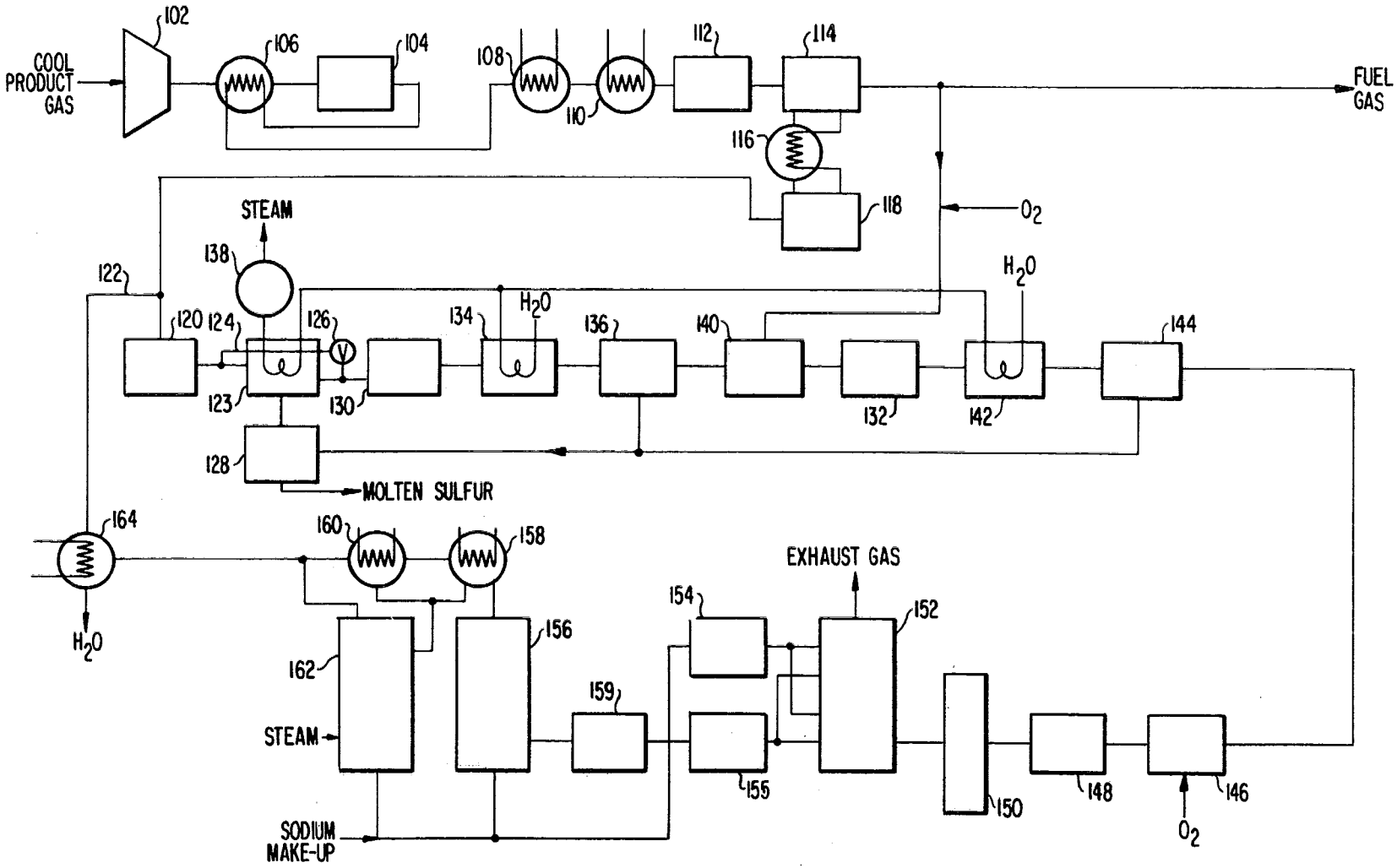
FIG. 2 is a schematic diagram of an embodiment of a method employing the process to produce fuel gas.

With reference to FIG. 2, a specific example is provided for illustration purposes to exemplify the method of producing fuel gas in accordance with the present invention and is not to be considered limiting. The gas from the gasification section is desulfurized to a level of 100 ppm total sulfur, maximum, to provide a fuel gas. This low sulfur level is obtained by utilizing a combination of carbonyl sulfide hydrolysis and hydrogen sulfide removal. For hydrogen sulfide removal, the alkazid process is employed. The concentrated hydrogen sulfide stream from the Alkazid solution regenerator is converted to elemental sulfur in a Claus unit.

In further detail, the gas from the gasification section is compressed in compressor 102 to a pressure of about 80 psig. Compression is only required for the gas when the gasifier is operated at pressures below the required delivery pressure. The compressors are steam turbine driven with a portion of the drive steam exhausting, and the remainder condensing. The reactant steam generated in the gasification waste heat trains at 1200 psig, 950° F. is expanded to the required feed pressure for the gasifier. The rest of the power is supplied by condensing the 1200 psig, 950° F. steam at 6 inches of mercury.

From the compressor, the gas is fed into catalytic hydrolysis unit 104 where the bulk of the carbonyl sulfide reacts with the contained water in presence of activated alumina or cobalt/molybdenum catalyst to form hydrogen sulfide and carbon dioxide. The feed gas temperature is raised to a hydrolysis reaction temperature, e.g., about 250° to 350° F., by heat exchange with hot effluent gases from the hydrolysis system in heat exchanger 106. The hydrolysis effluent is further cooled by air cooler 108 and finally water cooler 110 to about 100° F. Final cooling to the required temperatures for the alkazid absorber, i.e., to about 70° F., is provided by refrigeration unit 112.

In alkazid absorber 114, the hydrogen sulfide is selectively absorbed by the alkazid solution, an aqueous solution of the potassium salt of dimethylaminoacetic acid. The alkazid process exhibits selectivity for absorbing hydrogen sulfide in the presence of carbon dioxide, thus providing a more concentrated hydrogen sulfide feed, frequently about 20 volume percent, to the Claus unit. The spent solution from the absorber is regenerated by low pressure steam stripping in reboiled stripper 118 at about 220° to 260° F. at a pressure of about 0 to 10 psig. Heat interchange in exchanger 116 between spent and regenerated solutions reduces the quantity of low pressure steam used in the stripper reboiler. The overhead gases from the alkazid absorber, containing less than 100 ppm of sulfur, are sent to battery limits as product fuel gas.

The gas from reboiled stripper 118, after separation of a part of the contained moisture, containing, for instance, approximately 21 volume percent of hydrogen sulfide is fed to the Claus reaction furnace 120 together with the correct proportion of oxygen, e.g., about 3 moles of hydrogen sulfide per mole of oxygen, to provide 2 moles of $H_2S$ per mole of $SO_2$ in the effluent under flow control along with recycle sulfur dioxide via line 122 which can be from a regeneration section of a tail gas clean-up plant. The gases and oxygen burn together at burners designed to promote even mixing and combustion. The major sulfur forming reactions occur in this furnace but some unconverted hydrogen sulfide, sulfur dioxide and also small amounts of carbonyl sulfide and carbon disulfide pass through for conversion in downstream catalytic converters. The main reaction is:

$$3H_2S + 1\tfrac{1}{2}\,O_2 = 3H_2O + 3/x\,S_x.$$

The hot furnace gas is cooled by raising medium pressure steam in the fire tube waste heat boiler 123. Part of the elemental sulfur vapor present condenses and is drawn off to sulfur pit 128. Alternatively, further cooling, condensation of sulfur, and gas reheat may be provided to improve overall conversion.

The fire tubes of the waste heat boiler enclose a larger flue tube 124 through which hot furnace gas may be by-passed by down stream valve 126 under temperature control. By this means, the gas leaving the boiler tubes is reheated to a suitable temperature for sulfur forming reactions to occur in first stage converter 130, e.g., about 400° to 450° F. Other means, e.g., external by-passes or reheat furnaces may also be employed to provide a controlled inlet temperature to the first stage converter.

The main reaction in the first and second stage catalytic converters 130 and 132 is:

$$2H_2S + SO_2 = 2H_2O + 3/x\,S_x.$$

Hydrolysis of carbonyl sulfide and carbon disulfide is substantially completed in the first stage converter where a temperature increase of about 50° to 200° F. occurs due to the main and hydrolysis reactions. The catalyst employed in the first stage catalytic converter may be, for instance, bauxite, activated alumina or cobalt/molybdenum.

The gas from the first stage converter is cooled in first sulfur condenser 134 and sulfur mist is removed in the first coalescer 136. The condensed sulfur is drained to sulfur pit 128. The sulfur condenser transfer heat by generating steam on the shell side in conjunction with main waste heat boiler 123; generated steam being separated from circulating water in common steam drum 138.

After the first coalescer the gas is reheated by direct firing in auxiliary burner 140 in which fuel gas, or by-passed acid gas, is burned with slightly more than its stoichometric air requirement to maintain the correct inlet temperature to the second stage converted 132, e.g., about 400° to 450° F. employing the same type catalyst as the first stage converter. In a similar manner to the first stage inlet, alternative means for feed preheat may be employed.

The second sulfur condenser operates at a minimum temperature, e.g., about 260° to 300° F., to ensure efficient sulfur condensation and therefore only low pressure steam may be generated, which is passed to waste heat boiler 123. Alternatively the heat of condensation may be recovered by preheating boiler feed water. The sulfur separated in the second condenser and coalescer is drained to the sulfur pit 128.

The lower operating exit temperature of the second converter of about 450° to 500° F. favors sulfur formation to the extent that approximately 92 percent of the sulfur entering the plant as hydrogen sulfide may be recovered after the converted gas has been cooled and demisted in the second sulfur condenser 142 and its coalescer 144. Higher percentage sulfur recovery may be achieved by adding additional catalytic stages. This gas is then sent to the incinerator 146 where it is oxidized to convert sulfur and sulfur compounds to sulfur dioxide by air oxidation at relatively high temperatures, e.g., 1250° F. The effluent gas is sent to a sulfur dioxide recovery unit so that the final effluent to atmosphere is in compliance with air pollution regulations.

The exhaust gases from incinerator 146 are cooled by appropriate means, e.g., by generating steam in waste heat boiler 148 and then passing the gases to quench tower 150. The gas is cooled and water may be condensed such that a saturated gas at about 120° to 170° F. is fed to sulfur dioxide absorber 152.

The cooled gas then enters vertical two stage counterflow absorber 152 where it is contacted with a sulfite rich sodium sulfite-bisulfite solution at a temperature of, for instance, about 120° F. to 170° F. The sulfite in the solution is converted to the bisulfite by the absorption of sulfur dioxide. The absorber is designed to give the best use of energy, i.e., low pressure drop and low heat requirement, and still provide a suitable sulfur dioxide level in the exhaust gas. The bisulfite rich solution from the absorber is pumped to the sulfur dioxide regeneration unit.

An adequate amount of storage may be provided in vessels 154 and 155 for the circulating absorbent solution before and after the sulfur dioxide regeneration unit. This storage allows the absorption system to continue in operation should it be necessary to shut the regeneration unit down for minor repairs and clean outs.

The bisulfite rich absorbing solution is fed to a forced circulation evaporator 156 where sulfur dioxide and water vapor are evaporated from the solution resulting in a sulfite rich slurry. Indirect heater 159 may be provided to increase the temperature of the spent absorbing solution to the evaporator. The sulfur dioxide and water vapor mixture from the overheat stream of evaporator is partially condensed in primary condenser 158. This condensate, along with condensate from the secondary condenser 160, may be steam stripped in a condensate stripper 162 to remove sulfur dioxide, and then used as recycle water to dissolve the evaporator slurry crystals. Vapor from condenser 160 along with the overhead vapor from the stripper may be cooled in exchanger 164 and water vapor condensed to provide a highly concentrated (95 wt. %) sulfur dioxide product stream which is compressed and recycled to the Claus unit via line 122 at about 10 psig.

Any make-up sodium ions that are needed are added to the regenerated absorption solution exiting the evaporator 156 in the form of sodium hydroxide, sodium carbonate, or other suitable sodium salts and the resulting sulfite rich absorbing solution is pumped back to the sulfur dioxide absorber.

Figure 3:
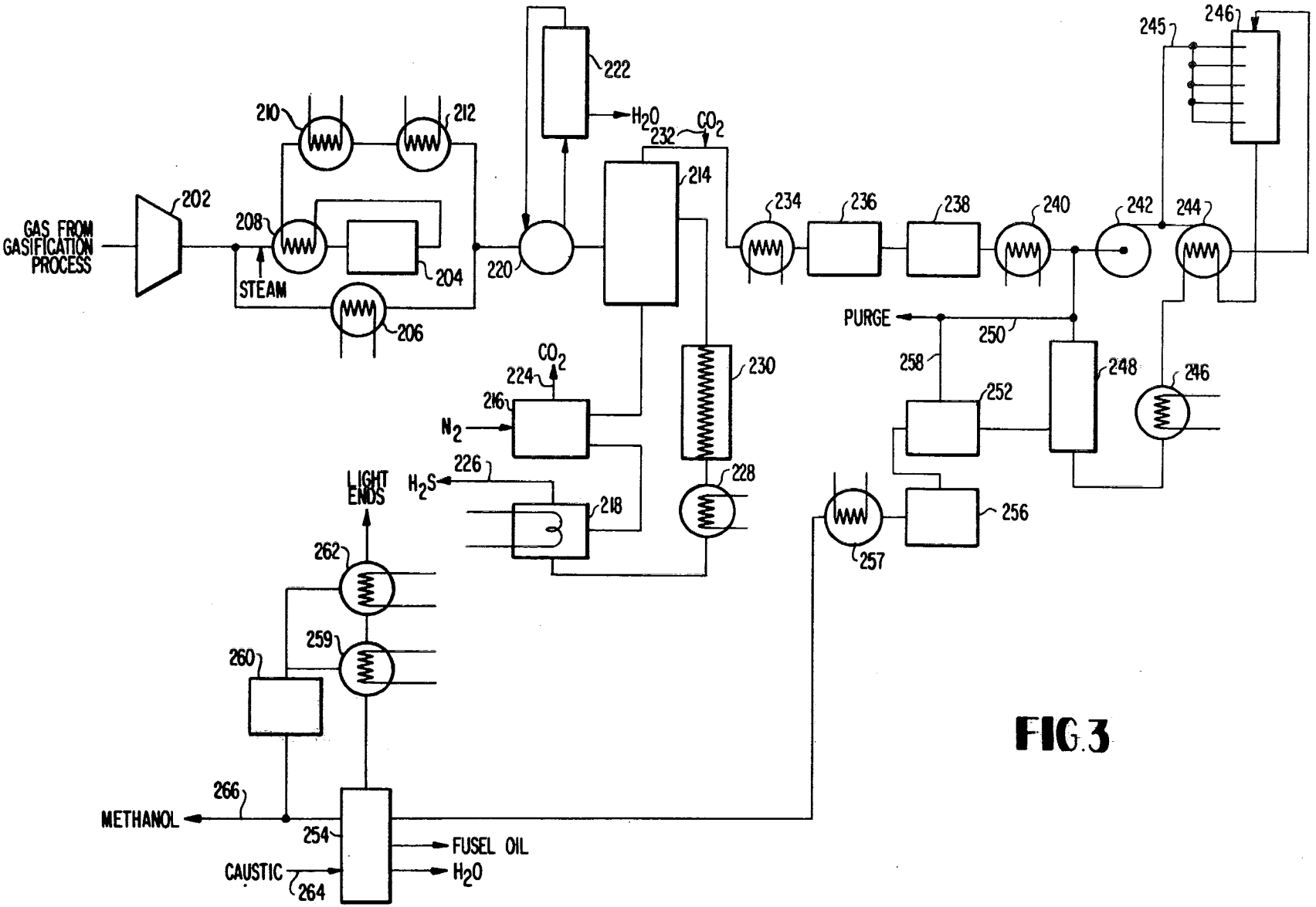
FIG. 3 is a schematic diagram of an embodiment of a method employing the process to produce methanol.

With reference to FIG. 3, a specific example is provided for illustration purposes to exemplify the method for producing methanol in accordance with the present invention and is not to be considered limiting. The methanol synthesis is conducted at approximately 100 atmospheres absolute and it has been found that it is more economical to compress the gas exiting the gasification unit prior to further processing. The cooled and dust free gas from the coal gasification section is compressed to about 1500 psig in multiple stages of compressor 202. Steam turbine drives using 1200 psig, 950° F. steam exhausting at 6 inches of Hg are used to drive the compressors. Cooling and condensate removal are employed after all but the final stage of compressions since the gas is to be preheated to 550° F. for the carbon monoxide shift reaction.

The purpose of the shift conversion step is to adjust the carbon monoxide to hydrogen ratio to that required for the methanol synthesis according to the exothermic shift reaction:

$$CO + H_2O = CO_2 + H_2$$

An exit CO content of about 6 volume percent in the shifted gas is achieved in a one stage shift conversion reactor 204 operating at about 550° F. and about 1500 psig. Part of the compressed gas, e.g. about 50%, is by-passed around the shift reactor, cooled in cooler 206 and mixed with the cooled shifted gas to yield an average CO content of approximately 20%. The shift catalyst to be used is sulfur resistant and is, for example, cobalt/molybdenum. The compressed gas to the shift reactor is mixed with the shift reaction steam to give about a 1:1 molar ratio of steam to the dry gas and preheated to 550° F. by heat interchange in exchanger 208 with the hot effluent gases from the shift reactor prior to its introduction to the reactor. From the interchanger, the shift effluent is cooled through a waste heat recovery unit 210 generating 50 psig steam from the boiler feed water and finally cooled to 95° F. by water in trim cooler 212.

The Rectisol process developed by Linde and Lurgi in Germany is employed to remove the acid gases. The Rectisol process absorbs $CO_2$ and $H_2S$ from the shifted synthesis gas stream using methanol as the absorbent in absorber 214. Carbon dioxide is rejected to the atmosphere and hydrogen sulfide rich gas is available for sulfur recovery in a manner as detailed above. These absorption streams are obtained by selectively regenerating the methanol from the absorber in a two stage regenerator scheme indicated by units 216 and 218. Refrigeration of the methanol stream to the absorber is required and water heat exchange 228 and refrigeration unit 230 serve this purpose. Because of the refrigeration, and also the diluent effect, water must be removed from the shifted gas being fed to the absorber by mixing liquid methanol with the gas in vessel 220 and separating the resultant wet methanol. The wet methanol is dried by distillation in distillation unit 222 and recycled to separation vessel 220. Low pressure nitrogen for the air separation section is used to strip carbon dioxide from the rich methanol solution in the first stage regenerator 216. Stripped solution from the first stage regenerator is stripped of its hydrogen sulfide by a steam (low pressure) heated reboiler in the second stage regenerator 218. The carbon dioxide stream with a trace of hydrogen sulfide is vented via line 224 from the first regenerator. The hydrogen sulfide stream exiting second regenerator 218 via line 226 flows to the Claus unit for sulfur recovery. The purified synthesis gas is now ready for methanol synthesis. The carbon dioxide content of the synthesis gas is controlled by mixing a desulfurized side stream of high carbon dioxide content from the absorber of the $SO_2$ recovery unit as detailed with respect to FIG. 2 via lin 232 with the absorber overhead from absorber 214 to provide a gas containing about 5 to 10% by volume $CO_2$.

The process employs a synthesis step using, for instance, a copper based catalyst developed by ICI which gives good yields of methanol at low temperatures, e.g., 410° F. to 520° F. The high activity of the catalyst at the low temperature permits the reaction to be carried out at pressures as low as 750 psig and pressures of about 1500 psig are frequently employed, thereby enhancing the economy of the process. By-product formation is minimized as a result of the low operating temperature, thus leading to high process material efficiencies.

Final traces of sulfur are removed from the synthesis gas by a bed of zinc oxide in vessel 236 after preheating to desulfurization temperature of about 650° F. in steam heater 234. A bed of chloride catch, i.e., chloride catch Z125–1 of Chemicals and Catalysts, Inc., in vessel 238 is also provided to prevent chloride poisoning of the synthesis catalyst. After cooling to about 100° F. in heat exchanger 240, the make-up synthesis gas enters the synthesis loop at the inlet of the circulator 242. The circulator circulates the gases around the synthesis loop and is a centrifugal machine with a direct steam turbine drive. The mixture of unconverted gas and fresh make-up gas is preheated to reaction temperature in converter interchanger 244 by the hot gases leaving the converter. The methanol synthesis converter is pressure vessel 246 of straight forward design containing a single bed of catalyst. Temperature control is effected by injecting cold gas feed gas via line 245 at appropriate levels into the catalyst bed using distributors. The distributors provide excellent mixing and permit free flow of catalyst between them to allow rapid catalyst filling and removal.

The reactants form methanol as they pass downwards over the catalyst. The converter exit gas is first cooled to about 100° F. in converter interchanger 244 and subsequently in crude methanol condenser 246 where the crude methanol produce is condensed. The crude product is separated out in high pressure separator 248 which is essentially a knock out type unit with a stainless steel demister to give high efficiency separation. The non-reactive components of the make-up gas, methane and nitrogen, are purged from the synthesis loop between separator 248 and the point of make-up gas addition, and the purge gas may be ultimately used for boiler fuel.

The crude methanol collected in the separator is letdown in a single stage to letdown vessel 252 and the resultant product at a pressure of about 25 to 50 psia and a temperature of about 100° F. passes to distillation plant 254. To provide some independent operation of the synthesis and distillation units the crude methanol can be pumped to crude methanol storage tank 256.

Flash gas, mostly previously dissolved gases, exiting via line 258 from the letdown vessel is mixed with the synthesis loop purge stream and used as fuel.

The crude methanol is processed in a single column distillation system to fuel grade methanol. The overall efficiency of the distillation system is expected to be 99%.

The upper section of the column removes the light ends, principally dimethyl ether, methyl formate, aldehydes, ketones, and lower paraffin hydrocarbons. The section of the column below the feed tray is designed to remove water. The feed, heated to its boiling point by 50 psig steam, in heat exchanger 257 enters the top section of the column. The overhead vapor, rich with light ends, passes to primary reflux condenser 259 and the condensate at a temperature of about 150° to 200° F. flows to the reflux drum 260. The uncondensed vapor and residual synthesis gas pass into secondary reflux condenser 262 for further condensing of methanol. This arrangement of condensers is designed to avoid sub-cooling of the reflux returned to the column. The uncondensed gases from the secondary condenser are flared.

Fusel oil predominantly alcohols such as isobutanol) is purged from a tray near the base of the column. In order to reduce organic and thermal losses in the effluent water stream the fusel oil may be subsequently blended back into product fuel grade methanol. The fusel oil may be burned as fuel if chemical grade methanol is the desired product.

The column reboiler is heated by low pressure steam and, as the bottoms would be slightly acidic, caustic is injected via line 264 below the feed tray to prevent corrosion.

Methanol product is removed from the top section of the column via line 266, cooled and pumped to storage at 113° F. and 100 psig.

A methanol plant of 5000 TPD capacity from coal requires large tonnage oxygen for coal gasification. It is economical to include an oxygen production unit in the facilities. A standard cryogenic air separation unit producing 1600 TPD per train of oxygen can be used. The by-product nitrogen from this unit may be utilized in the plant for purging and Rectisol unit methanol stripping. The air separation unit air and oxygen compressors may be turbine driven using both non-condensing and condensing drives. The reactant steam required for the coal gasification plant may be available from the non-condensing turbine drive, using 1200 psig, 950° F. expanded to the required pressure for the gasifiers.

Figure 4:
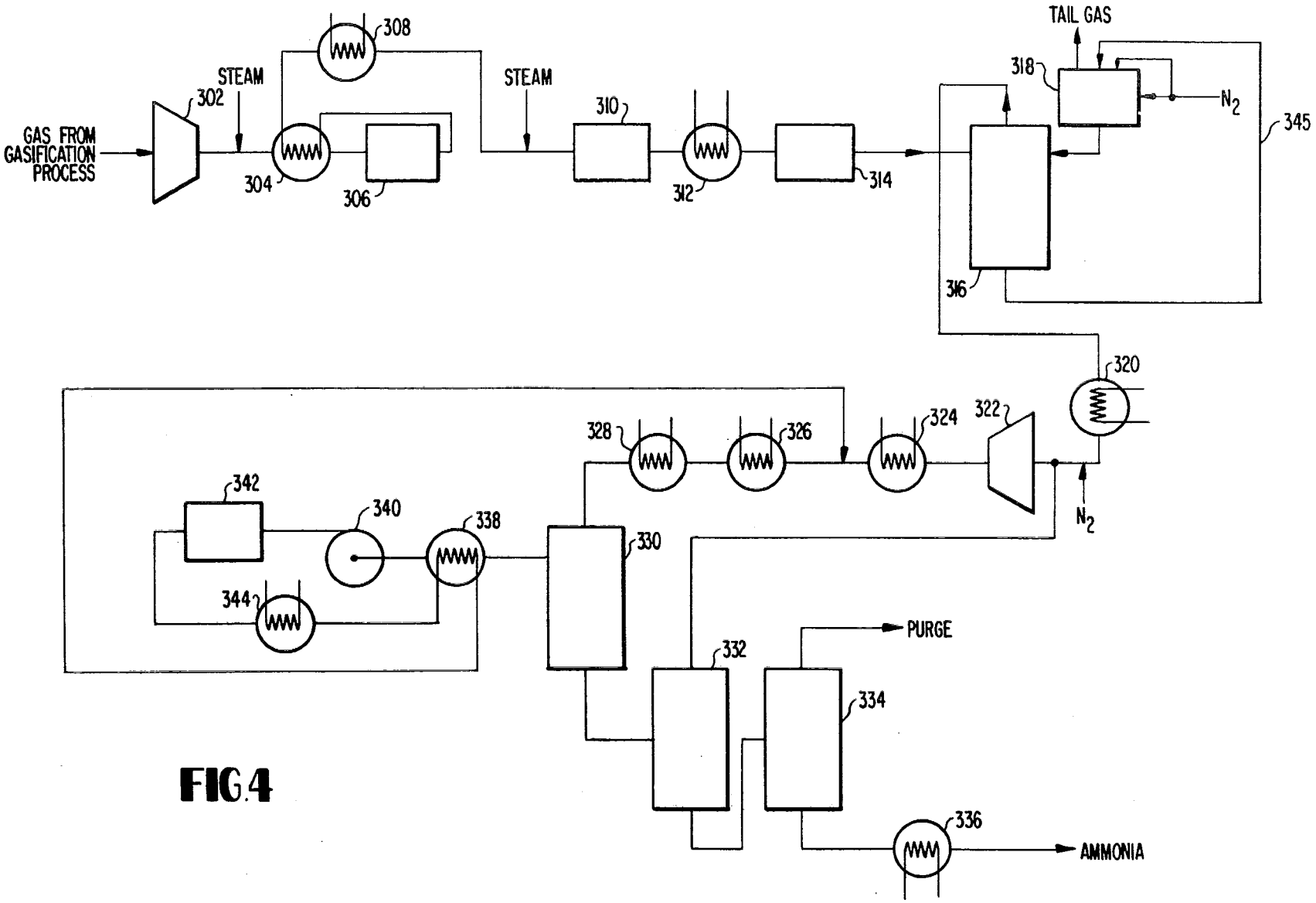
FIG. 4 is a schematic diagram of an embodiment of a method employing the process to produce ammonia.

With reference to FIG. 4 a specific example is provided for illustration purposes to exemplify the method of the present invention for producing ammonia and is not to be considered as limiting. The ammonia synthesis is conducted at high pressure and it has been found that it is more economical to compress the raw gas from the gasification section prior to further processing. The cooled and dust-free gas from the coal gasification section is compressed to about 1265 psig in a multistage compressor 302 with steam turbine drives using 1200 psig, 950° F. steam exhausting at 6 inches of Hg. Cooling and condensate removal are performed after all but the final stage of compression where the gas leaving is preheated to about 550° F. for the carbon monoxide shift reaction.

The purpose of the shift conversion step is to maximize the yield of hydrogen according to the exothermic shift reaction:

$$CO + H_2O = CO_2 + H_2$$

An exit CO content of about 1.3 volume percent from the shift conversion unit is employed as this concentration would yield a nominal 2.0 volume percent CO concentration feeding the nitrogen wash column. This level of carbon monoxide is achieved by two stages of shift conversion over a sulfur resistant shift catalyst, e.g., cobalt/molybdenum. The compressed gas to first stage shift reactor 306 is mixed with the shift reaction steam to give about a 1:1 molar ratio of steam to dry gas and preheated to 550° F. by heat interchange in heat interchange 304 with the hot effluent gases from the first stage reactor.

The gas from the first stage contains approximately 6.5 volume % carbon monoxide. From the interchanger the gas is cooled to 550° F. by raising 250 psig steam in heat exchanger 308. Steam is again added to obtain about a 1:1 molar steam to gas ratio before entering second stage shift conversion reactor 310. The hot gas from the second stage reactor is cooled to 95° F. by raising medium pressure and low pressure steam, preheating boiler feedwater streams, preheating make-up high pressure boiler feedwater, an air cooler, and finally by a water cooled trim cooler (all generally designated as heat exchanger 312). The cooled gas flows to the acid gas removal section.

The Rectisol Process is employed to remove the acid gases. This process is conducted essentially in the same manner as the Rectisol Process unit described with respect to FIG. 3 and is generally designated as unit 314.

The nitrogen wash is utilized to remove the residual methane and carbon monoxide and to provide a stoichiometric ratio of hydrogen to nitrogen. The hydrogen rich gas stream from the Rectisol Process passes to nitrogen wash column 316 at a temperature of about −50° to −75° F. and pressure of about 1050 psia where it is mixed with the nitrogen from an air separation unit. The nitrogen wash system consists of this single wash column plus heat exchangers. By expanding part of the high pressure nitrogen into the tailgas expander/heat exchanger 318, enough refrigeration is obtained to liguefy part of the remaining high pressure nitrogen. Using this liquid nitrogen as feed into the top of the wash column, the remaining inpurities, e.g., carbon monoxide and methane, are washed out of the hydrogen rich gas. The liquid nitrogen leaving column 316 is conducted via line 345 into tail gas expander 318. The hydrogen/nitrogen mixture exiting the nitrogen wash column is heated in heat exchanger 320 and adjusted to stoichiometric ammonia synthesis gas by adding additional high pressure nitrogen from the air separation unit.

The synthesis gas stream flows to the ammonia synthesis section for final compression in compressor 322 to about 3400 to 3500 psia before entering the ammonia loop. The tailgas containing methane, carbon monoxide and nitrogen may be fired as supplemental fuel in a boiler in an offsites section. The compressed gas is then cooled in the synthesis gas compressor aftercooler 324 to about 120° to 150° F. The cooled make-up gas is mixed with partially cooled ammonia converter effluent. The mixed gases are then cooled and condensed via ammonia refrigeration in primary and secondary chillers 326 and 328. The ammonia is separated from the converter feed stream in the ammonia knockout vessel 330. The liquid ammonia is depressured in two stages to reduce the dissolved gas content to an acceptable level. The gases from primary letdown vessel 332 are recycled to the suction of the synthesis gas compressor 322. The gases evolved in secondary letdown vessel 334 are purged to the plant fuel system. The product ammonia from this vessel is cooled with a refrigeration stream from the acid gas removal section in heat exchanger 336 to −28° F. and passed to battery limits for storage. The use of the refrigeration stream from the synthesis gas preparation section eliminates the need for a subatmospheric stage on the ammonia refrigeration system as well as product pumps.

The gases from the ammonia knockout drum are reheated by exchange with the converter effluent gases in converter feed interchange 338, prior to being sent to ammonia converter 342 via circulator 340. The gases entering the converter are at a temperature of about 60° to 100° F. and pressure of about 3600 to 3700 psia.

The gases from the ammonia converter are cooled in a series of exchangers prior to being mixed with the make-up synthesis gas. This cooling train consists of the loop boiler feedwater heater, the air cooled loop cooler, the water cooled loop cooler, all generally indicated as heat exchanger 344 and the previously mentioned feed interchanger.

The ammonia refrigeration system is of superatmospheric design, the lowest pressure being 15 psig at the low pressure end of the steam turbine driven refrigeration compressor. This compressor is of split pressure design with the intermediate inlet pressure being 35 psig. The system is compressed of the refrigeration compressor, the refrigeration condenser, the refrigerant receiver, the primary and secondary chillers and the high pressure suction drum. The use of an intermediate pressure stage results in substantial savings in compression power. In theory, increasing the number of intermediate pressure stages would result in further power savings but this is often found to be uneconomical.

The ammonia plant of 1200 TPD capacity requires large tonnage oxygen for coal gasification. It is therefore economical to include an oxygen production unit in the facilities. A standard cryogenic air separation unit having a capacity of 1000 TPD of oxygen can be used. The by-product low pressure nitrogen from this unit may be utilized in the plant for purging Rectisol unit methanol stripping, and nitrogen wash. The high pressure nitrogen may be utilized for ammonia synthesis. The air separation unit air and oxygen compressors may be turbine driven using both non-condensing and condensing steam drives. The reactant steam required for the coal gasification plant may be obtained from the non-condensing turbine exit, using 1200 psig 950° F. expanded to the required pressure for the gasifiers.

Various modifications and equivalents will be apparent to one skilled in the art and may be made in the process or methods of the present invention without departing from the spirit or scope thereof and it is, therefore, to be understood that these modifications and equivalents are also convered.

We claim:

1. An efficient and economical process for continuously gasifying particulate carbonaceous material under selective conditions to produce, in an environmentally-acceptable manner, a gaseous product rich in carbon monoxide and hydrogen using pressurized gasifier means having a lower, dense-phase, fluidized bed of the material and contiguous to the upper phase boundary of the bed, an upper dilute-phase, particulate-entrained, gas zone which comprises introducing, in the gasifier, particulate carbonaceous material at a pressure slightly in excess of the pressure in the gasifier, at a temperature from about ambient to 1,000° F., and with amounts of the material at a rate sufficient to maintain the upper phase boundary of the fluidized bed at a given level of about 4 to 20 feet above the lower phase boundary of the fluidized bed wherein the ratio of the height of the diute phase, gas zone to the height of the fluidized bed is from about 3:1 to 10:1;

introducing oxygen-containing gas with up to about 50 percent (vol.) of steam at average bulk temperatures up to about 1000° F., at a pressure slightly in excess of that in the gasifier, at spatially-separate points, substantially uniformly distributed circumferentially, at different levels in the gasifier and in amounts sufficient to substantially uniformly contact and gasify the constituents of the fluidized bed under controlled selective reaction conditions;

introducing at least about 50 percent (wt.) of the steam being introduced into the fluidized bed, at the lower phase boundary of the fluidized bed, at spatially-separate points, substantially uniformly distributed circumferentially, at a temperature up to about 1200° F., at a pressure slightly in excess of that in the gasifier, and at a rate sufficient to fluidize the lower portion of the bed;

gasifying the material in the fluidized bed to provide a maximum temperature in the gasifier in the range of about 1500° to 2400° F. and at a bulk temperature in the dense phase below the softening temperature of any ash contained in the material to produce a gaseous reaction product including carbon monoxide, hydrogen, carbon dioxide, methane and diluents, which product evolves into the dilute phase, and in conjunction with such production partially spent char solids are produced;

introducing additional increments of oxygen-containing gas with up to about 10 percent (vol.) of steam at or just above the phase boundary between the fluidized bed and dilute phase at spatially-separate points, substantially uniformly distributed circumferentially, in amounts sufficient to react with carbon values leaving the fluidized bed, thus increasing the temperature in the dilute-phase, and to enhance the carbon-conversion efficiency of the process to provide a raw product gas containing at least about 50 percent of the oxidized carbon in the form of carbon monoxide;

passing the gaseous reaction product through the dilute phase at a superficial velocity well above the point of incipient fluidization and up to about 20 feet per second, and for a residence time in the dilute-phase of about 2 to 5 seconds to undergo further gasification and produce a raw product gas, maintaining the dilute-phase at a maximum temperature possible commensurate with the properties of any contained ash;

removing the raw product gas from said upper dilute-phase zone;

removing up to about 60 percent (wt.) of partially spent char from the bottom of the bed and containing the char with steam being introduced into the bed at the lower phase boundary to recover sensible heat from the char and preheat the steam;

providing a cooled product gas from said raw product gas, said cooled product gas having less than about 4 grains of solid per standard cubic foot of gas at approximate gasifier pressures and at temperatures better suited for further processing, wherein substantial amounts of partially spent char are removed from the raw product gas for discharge from the process or for recycle or for reprocessing under different conditions, and wherein the cooling of the raw product gas to temperatures of about 200° F. to 500° F. is conducted in a heat recovery zone to recover heat values;

employing recovered heat values from said heat recovery zone to produce steam, a portion of which is utilized in the process;

conducting the cooled product gas, cooled in a heat recovery zone at the heat recovery zone pressures, which are less than the pressures in the gasifier, through a high efficiency, high pressure-drop type, scrubber to remove fine partially spent char particles and provide a gas product containing less than about 0.1 grains of solids per standard cubic foot of gas, a carbon monoxide content of at least about 10 percent (vol.), a hydrogen content of at least about 10 percent (vol.), and a BTU content of at least about 90 BTU per standard cubic foot; and maintaining the pressure in the gasifier at super-atmospheric pressures including pressures above about 1.5 atmospheres absolute by means of back-pressure control applied to the gas system at a point downstream of the gasifier.

2. The process of claim 1 wherein the pressure in the gasifier is from about 2 to 20 atmospheres absolute.

3. The process of claim 1 wherein the pressure in the gasifier is from about 6 to 14 atmospheres absolute.

4. The process of claim 2 wherein the maximum temperature in the gasifier is from about 1700° to 2200° F.; the raw product gas contains about 55 to 85 percent of the oxidized carbon in the form of carbon monoxide; and the high efficiency, high pressure-drop type, scrubber is a venturi scrubber which provides a gas product containing less than about 0.01 grains of solid per standard cubic foot of gas.

5. The process of claim 2 wherein a height to maximum diameter ratio of the fluidized bed at about 1:2 to 5:1 is maintained.

6. The process of claim 4 wherein the oxygen-containing gas is air.

7. The process of claim 4 wherein the oxygen-containing gas is oxygen-enriched air or oxygen.

8. The process of claim 4 wherein the oxygen-containing gas is oxygen.

9. The process of claim 1 wherein the cooled product gas containing less than 0.1 grains of solids per standard cubic foot of gas is employed as a feedstock for producing fuel gas.

10. The process of claim 4 wherein the oxygen-containing gas is air and the cooled product gas containing less than 0.01 grains of solids per standard cubic foot of gas is employed as a feedstock for producing low BTU fuel gas.

11. The process of claim 4 wherein the oxygen-containing gas is oxygen-enriched air and the cooled product gas containing less than 0.01 grains of solids per standand cubic foot of gas is employed as a feedstock for producing low or medium BTU fuel gas.

12. The process of claim 4 wherein the oxygen-containing gas is oxygen and the cooled product gas containing less than 0.01 grains of solids per standard cubic foot of gas is employed as a feedstock for producing medium BTU fuel gas.

13. The process of claim 8 wherein the carbonaceous material is introduced into the gasifier at or below the upper phase boundary of the fluidized bed and the cooled product gas containing less than 0.01 grains of solids per standard cubic foot of gas is employed as a feedstock for producing methanol.

14. The process of claim 1 wherein the carbonaceous material is introduced into the gasifier at or below the upper phase boundary of the fluidized bed and the cooled product gas containing less than 0.1 grains of solids per standard cubic foot of gas is employed as a feedstock for producing ammonia.

15. The process of claim 8 wherein the carbonaceous material is introduced into the gasifier at or below the upper phase boundary of the fluidized bed and the cooled product gas containing less than 0.01 grains of solids per standard cubic foot of gas is employed as a feedstock for producing ammonia.

16. A method for producing fuel gas which comprises introducing the cooled product gas, having less than 0.1 grains of solids per standard cubic foot of gas and which contains carbonyl sulfide and hydrogen sulfide, of claim 1 into a desulfurization zone to, in a first phase, hydrolyze carbonyl sulfide under hydrolysis conditions, in the presence of carbonyl sulfide-hydrolyzing catalyst, to hydrogen sulfide and provide a hydrolysis product gas which contains increased amounts of hydrogen sulfide; and, in a second phase, subjecting the hydrolysis product gas to hydrogen sulfide-absorption conditions to remove hydrogen sulfide and provide a desulfurized fuel gas.

17. A method of claim 16 wherein hydrolysis conditions include the use of a hydrolysis pressure in excess of 60 psia.

18. The method of claim 17 wherein the hydrolysis conditions include a temperature of about 200 to 400° F. and the hydrogen sulfide-absorption conditions include a temperature of 70° to 100° F. and a pressure in excess of about 60 psia.

19. The method for producing fuel gas of claim 17 wherein the oxygen-containing gas introduced into the gasifier is air and a low BTU fuel gas is produced.

20. The method for producing fuel gas of claim 17 wherein the oxygen-containing gas introduced into the gasifier is oxygen-enriched air and a low or medium BTU fuel gas is produced.

21. The method of claim 17 wherein the oxygen-containing gas introduced into the gasifier is oxygen and a medium BTU fuel gas is produced.

22. A method for producing methanol which comprises introducing the cooled product gas having less than 0.01 grains of solid per standard cubic foot of gas of claim 13 into a shift reaction zone; subjecting gas in the shift reaction zone to a shift reaction with water vapor under shift reaction conditions including the presence of a sulfur resistant shift catalyst, a temperature of about 500° to 900° F. and a pressure in excess of 200 psia to provide a gas containing approximately 20 percent carbon monoxide; desulfurizing the gas; reacting carbon oxides and hydrogen in the desulfurized, shifted gas under methanol synthesis conditions including the use of a methanol synthesis catalyst and temperature of 410° F. to 520° F., to provide methanol; and recovering methanol.

23. A method for producing ammonia which comprises introducing the cooled product gas having less than 0.01 grains of solid per standard cubic foot of gas of claim 14 into a shift reaction zone; subjecting gas in the shift reaction zone to a shift reaction with water vapor under shift reaction conditions including the presence of a sulfur resistant shift catalyst, a temperature of about 500° to 900° F. and a pressure in excess of 200 psia to provide a gas containing less than about 3 volume percent of carbon monoxide; desulfurizing the gas; washing the desulfurized, shifted gas with liquid nitrogen to remove carbon monoxide and methane and provide a gas containing stoichiometric ratio of hydrogen to nitrogen; reacting the hydrogen and nitrogen under ammonia synthesis conditions including a temperature of about 600° to 1000° F. and a pressure in excess of 2000 psia to provide ammonia; and recovering the ammonia.

24. The method of claim 23 wherein the oxygen-containing gas is oxygen.

25. The process of claim 4 wherein the solid carbonaceous material is coal.

26. The process of claim 1 wherein methane-enhancing conditions, including the introduction of the carbonaceous material into the gasifier above the upper phase boundary of the fluidized bed, are employed in the gasifier to produce greater amounts of methane in the product gas.

27. The process of claim 26 wherein the methane-enhancing conditions include temperatures from about 1500° F. to 1700° F.

28. The process of claim 27 wherein the methane-enhancing conditions include a pressure of at least about 10 atmospheres absolute and the amount of steam employed is reduced in preference to replacement with recycle gas.

* * * * *

UNITED STATES PATENT OFFICE
CERTIFICATE OF CORRECTION

PATENT NO. : 4,017,272
DATED : April 12, 1977
INVENTOR(S) : Jamil Anwer, et al.

It is certified that error appears in the above-identified patent and that said Letters Patent are hereby corrected as shown below:

Column 2, line 34 -- the word "intergrated" should be --integrated--.

Column 3, line 5 -- the word "the" should be deleted.

Column 3, line 7 -- the word "from" should be --form--.

Column 4, line 44 -- the word "by" should be --may--.

Column 6, line 21 -- the first word in the paragraph should have a capital "T".

Column 6, line 64 -- the word "reaction" should be --reactions--.

Column 7, line 13 -- the word "vaiables" should be --variables--.

Column 7, line 28 -- the word "processing" should be --reprocessing--.

Column 7, line 37 -- the word "spend" should be --spent--.

Column 12, line 19 -- the word "drug" should be --drum--.

Column 16, line 15 -- the word "converted" should be --converter--.

Column 18, line 28 -- the word "lin" should be --line--.

UNITED STATES PATENT OFFICE

CERTIFICATE OF CORRECTION

PATENT NO. : 4,017,272

DATED : April 12, 1977

INVENTOR(S) : Jamil Anwer, et al.

It is certified that error appears in the above-identified patent and that said Letters Patent are hereby corrected as shown below:

Column 18, line 67 -- the word "produce" should be --product--.

Column 19, line 38 -- the beginning parenthesis symbol should appear after the word --oil--.

Column 20, line 60 -- the word "liguefy" should be --liquefy--.

Column 21, line 48 -- the word "compressed" should be --comprised--.

Column 22, line 28 -- the word "diute" should be --dilute--.

Column 23, line 5 -- the number "5" should --50--.

Column 23, line 13 -- the word "containing" should be --contacting--.

Column 24, line 13 -- the word "standand" should be --standard--.

Column 25, line 14 "temperature" should be --temperatures--.

Signed and Sealed this nineteenth Day of July 1977

[SEAL]

Attest:

RUTH C. MASON
Attesting Officer

C. MARSHALL DANN
Commissioner of Patents and Trademarks